US007662012B2

(12) United States Patent
Wright

(10) Patent No.: US 7,662,012 B2
(45) Date of Patent: Feb. 16, 2010

(54) THROWABLE TOY HAVING SPRING ASSISTED MOTION

(76) Inventor: Eric E. Wright, 420 School St., Floor 1, Verona, PA (US) 15147

( * ) Notice: Subject to any disclaimer, the term of this patent is extended or adjusted under 35 U.S.C. 154(b) by 0 days.

(21) Appl. No.: 12/504,986

(22) Filed: Jul. 17, 2009

(65) Prior Publication Data

US 2009/0275262 A1 Nov. 5, 2009

Related U.S. Application Data

(63) Continuation-in-part of application No. 11/532,221, filed on Sep. 15, 2006.

(51) Int. Cl.
*A63H 27/00* (2006.01)
*A63H 33/00* (2006.01)

(52) U.S. Cl. ..... 446/34; 446/61; 446/486; 446/487

(58) Field of Classification Search ..... 446/34, 446/260, 486, 61, 68, 71, 73, 76, 487; 473/588, 473/589

See application file for complete search history.

(56) References Cited

U.S. PATENT DOCUMENTS 2,683,603 A * 7/1954 Gackenbach ..... 473/613
3,264,776 A * 8/1966 Morrow ..... 446/34
4,151,674 A * 5/1979 Klahn et al. ..... 446/34
4,850,923 A * 7/1989 Etheridge ..... 446/34
5,397,261 A * 3/1995 Malewicki et al. ..... 446/71
5,685,076 A * 11/1997 Curley et al. ..... 29/897.3
5,810,637 A * 9/1998 Mileti ..... 446/61
6,083,128 A * 7/2000 Young et al. ..... 473/576

* cited by examiner

*Primary Examiner*—Kien T Nguyen
(74) *Attorney, Agent, or Firm*—Fox Rothschild LLP; Dennis M. Carleton

(57) ABSTRACT

A throwable device consisting of a generally tube-shaped body having a baffle defined on one end of the body, wherein the baffle defines an opening therein restricting the flow of air through the tube-shaped body, thereby providing aerodynamic stability to the device. The body of the device also has a spring integral therewith, which allows the compression of the body of the device. The device is propelled away from the thrower by holding the device in a compressed position with both hands and propelling the device away from the body of the thrower in a motion similar to a two-handed basketball pass, with a combination of the throwing force and the decompression of the spring determining the speed, distance and trajectory of the device.

20 Claims, 5 Drawing Sheets

THROWABLE TOY HAVING SPRING ASSISTED MOTION

RELATED APPLICATIONS

This application is a continuation-in-part of co-pending U.S. application Ser. No. 11/532,221, filed Sep. 15, 2006.

FIELD OF THE INVENTION

The invention relates generally to the area of toys, and, in particular, to throwable-type toys which may be used in throwing games between individuals at a range of approximately one to twenty meters.

BACKGROUND OF THE INVENTION

Throwable-type toys are well known in the art and have been used as a source of entertainment for children and adults alike for generations, Aside from typical ball-type throwable toys, such as baseballs and footballs, other types of throwable toys have gained popularity over the years, such as the Frisbee® and Frisbee-like devices, such as, for example, aerodynamic rings, Such toys are typically spherical or disc-shaped and rely on the strength of the initial throwing motion and the shape of the toy to determine the flight characteristics of the device.

SUMMARY OF THE INVENTION

The primary embodiment of the device consists of a body portion in the general shape of a hollow tube having open ends, preferably principally constructed of a flexible material, having a spring assisted motion whereby the device expands from a compressed state to an expanded state as the device is released with a throwing motion, such that the expansion of the body of the device assists in propelling the device away from the thrower. Preferably, at least one end of the tube will have a baffle to assist in the aerodynamic airflow through the body of the device as it is propelled away from the thrower, and to add weight to the leading edge of the device for stability.

DETAILED DESCRIPTION OF THE INVENTION

Figure 1:
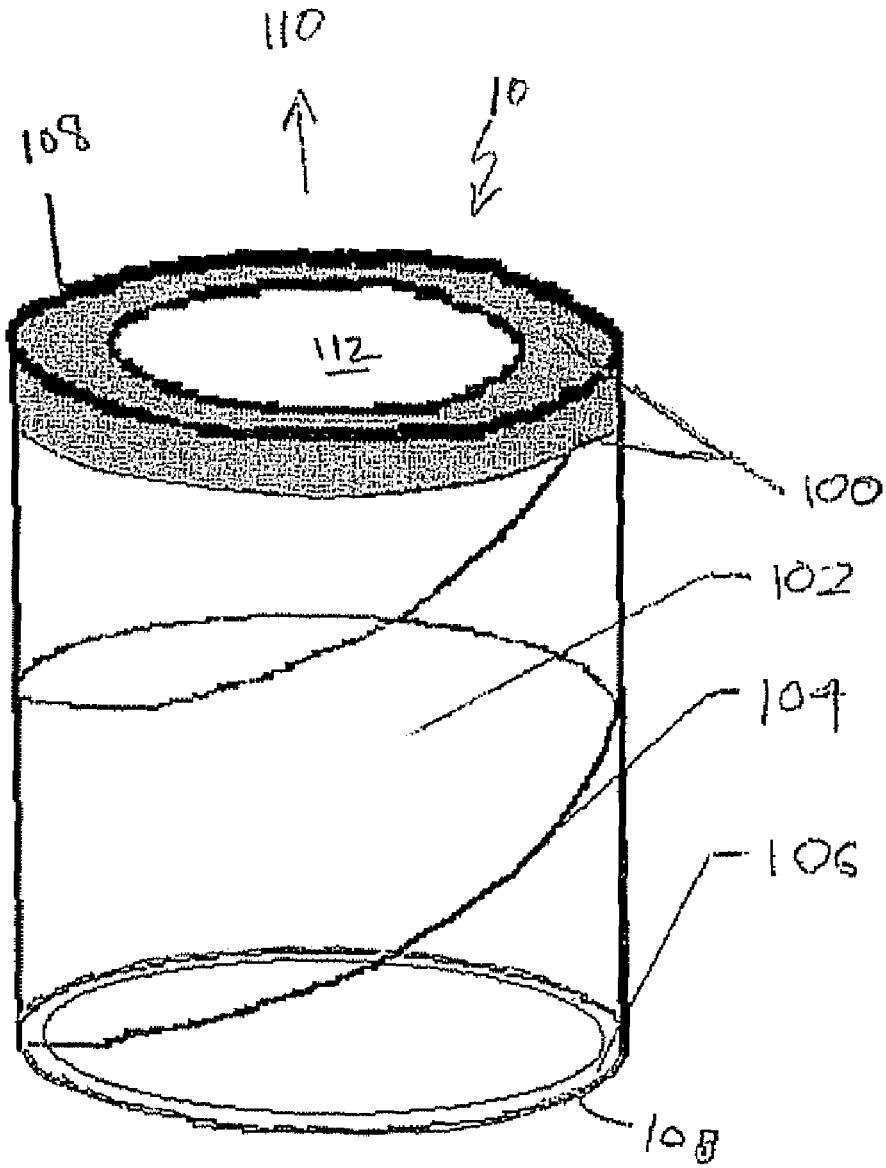
FIG. 1 is a transparent view of the preferred embodiment of the invention.
Figure 2A:
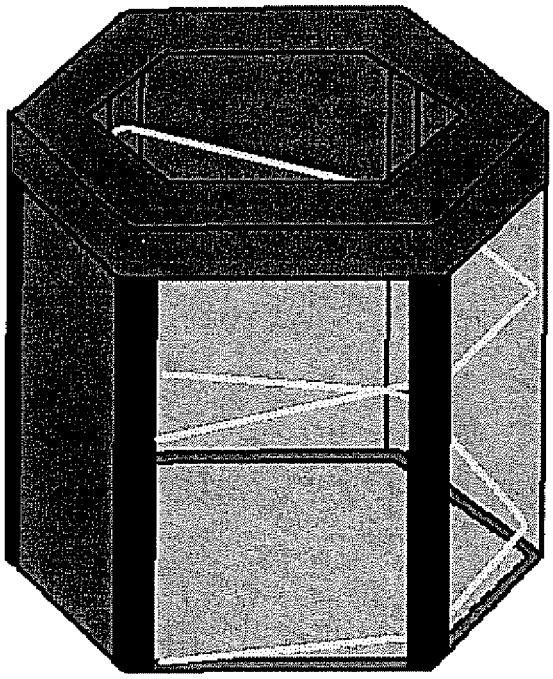
FIGS. 2A-2G show alternate embodiments of the invention, showing variations in the shape of the body of the device.
Figure 2B:
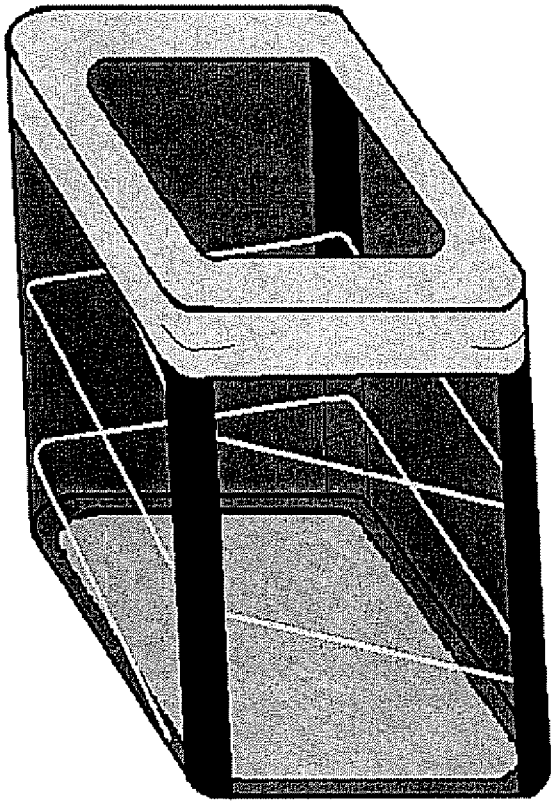
Figure 2C:
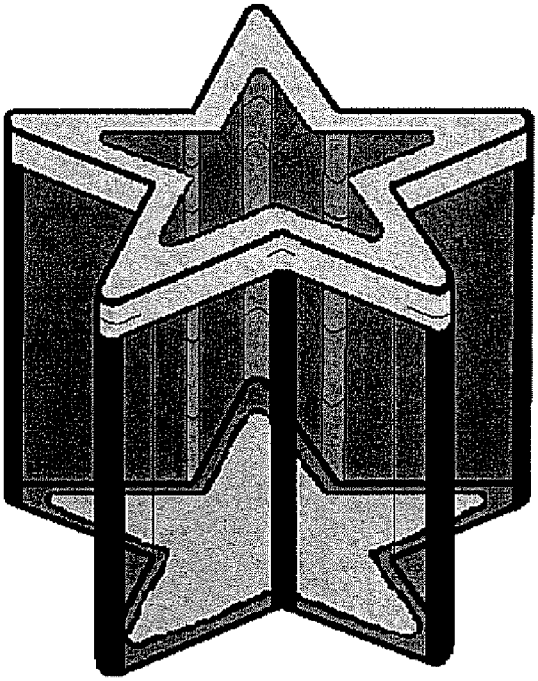
Figure 2D:
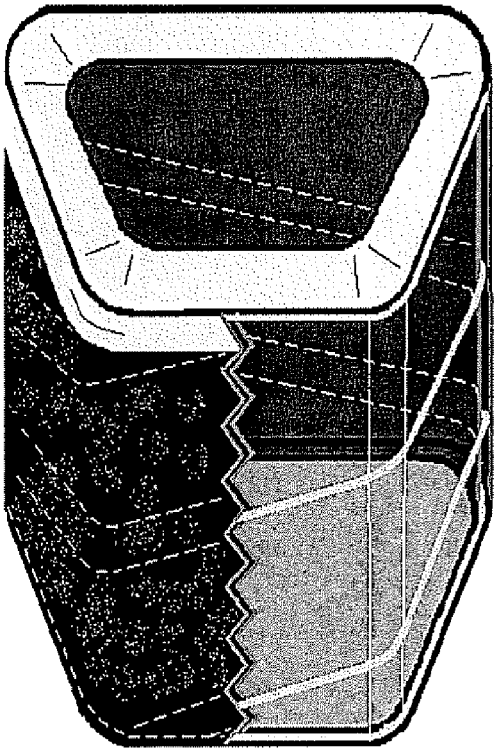
Figure 2E:
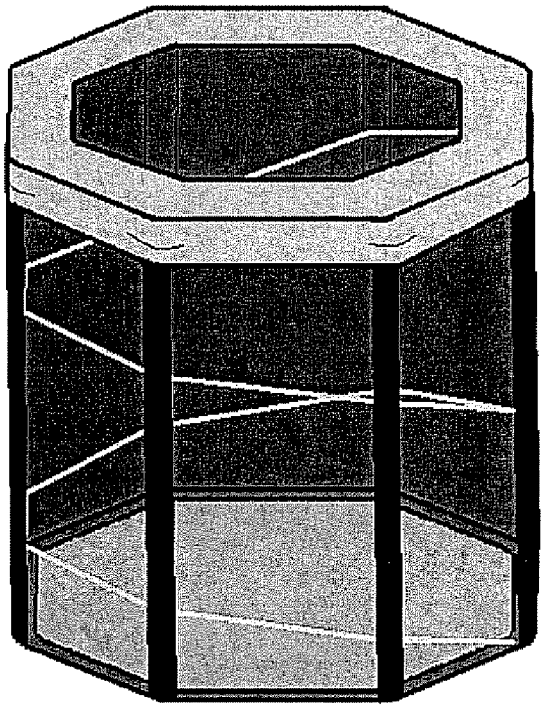
Figure 2F:
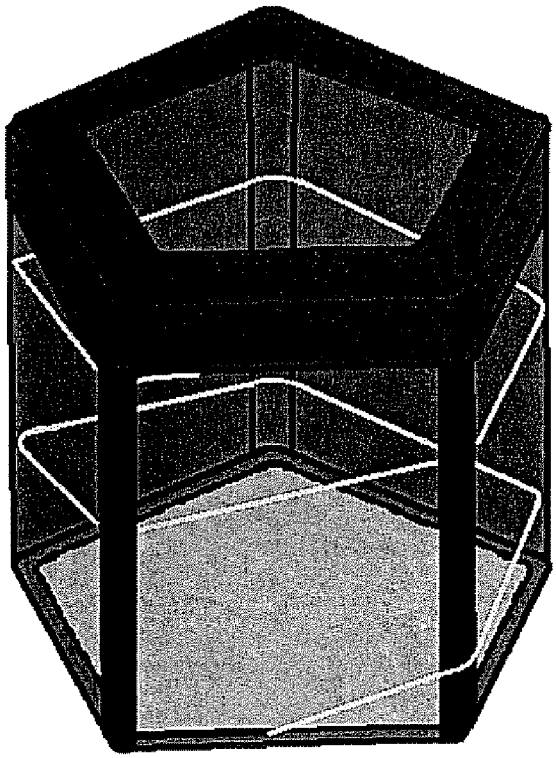
Figure 2G:
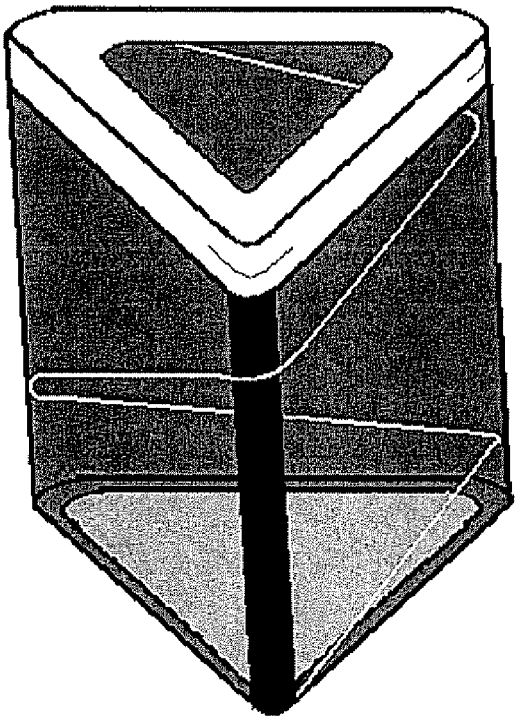

Device 10 as shown in FIG. 1 consists primarily of body portion 102 which is generally tube-shaped and circular in cross sectional shape. As show in FIGS. 2A-2G, alternative shapes may be utilized. Preferably, the bottom or trailing edge of the device is open ended and is shown as the end opposite the direction of travel 110 of the device. The leading edge of the device is nearest direction of travel 110 and has baffle 100 defining opening 122 disposed thereon. In the preferred embodiment, the diameter of the body 102 is approximately between 4 and 12 inches in diameter.

Body portion 102 can be composed of any flexible material including, for example, nylon, Kevlar, cotton or any fabric or polyvinyl and may be of any color, including transparent In the preferred embodiment, the body is composed of thick nylon formed into a circular tube-shape. Preferably, the material of which the device is made will be tough enough to resist tearing during play, which may involve contact with the ground or other objects, and to remain intact and retain its shape through multiple compressions and decompressions of the device. In an alternative embodiment, the body may be composed of a springy foam substance that is able to be compressed and thereafter returns to its original shape.

In the event that the body of the device is made of a fabric-like material, the spring feature of the device is provided by spring 104, which consists of a coiled wire attached to the periphery of the body of the device, preferable by sewing, as shown in FIG. 1. Preferably, spring 104 will be on the inside of the device such that it is not visible to the user of the device, and attached at multiple points to the fabric or other material of which body 102 is constructed. Optionally, wire rims 108 may be provided to form the top and bottom lips of the device, as shown in FIG. 1. The wire forming rims 108 may be contiguous with spring 104, that is, formed of the same piece of wire, or may be formed as separate pieces of wire. The device is provided with some rigidity by a fabric lip 106 which is formed in the open end of body 102 by layering, heavy stitching or needle pointing the end of body portion 102 nearest the open end. Lip 106 may be disposed over wire rim 108 or may act in lieu of wire rim 108 on the trailing edge of the device. The opening defined in the baffle portion of the device may also define a lip on the circumference thereof, which may have a wire integral therewith.

In an alternative embodiment, wherein the body of the device is composed of a springy foam material spring 104 and wire rims 108 may be eliminated and the central area of the device may be formed in a corrugated pattern, providing an accordion-like springing action. In addition, baffle 100, discussed below, may be formed integral with and composed of the same springy foam material as the body of the device.

The leading edge of the device has baffle 100 disposed thereon. Baffle 100 is attached to the top of the device, preferably by sewing, but it may be attached by any other means known in the art. In the preferred embodiment of the invention, baffle 100 may be a different color than body 102 of the device. Baffle 100 provides an opening 112 therein which restricts and directs air flow through the device as the device is propelled away from the thrower, creating a venturi effect and providing aerodynamic stability as the device moves through the air. Preferably, the area of the opening 112 in baffle 100 will be between approximately 25% and 50% of the area of the rear open end of the device, or of the cross-sectional area of the device, as shown in FIG. 1. Thus, if the overall device is 6" in diameter, opening 112 should have a diameter of between approximately 3" and 4.25".

The leading edge of the device should be weighted with respect to the trailing edge of the device, with the weight being provided either by wire rim 108 or by any other means of providing a weighted front end, such as constructing baffle 100 from gel filled neoprene, utilizing a needle pointing process or adding additional wires integral with the baffle or leading edge of the device. In the embodiment wherein the body of the device is composed of a springy foam material, the separate baffle may be omitted and instead baffle 100 would be formed integrally with the body of the device.

Spring 104 of the device is preferably composed of a heavy wire which allows the body of the device be compressed and easily and forcibly returned to its uncompressed state when released.

As shown in FIGS. 2A-2G body 102 of the device may be of any conventional shape. In shapes having outside corners, additional stitching may be required to define the corners thereof and preferably, spring 104 will be shaped to match the inside shape of the body 102 instead of retaining the circular spiral shape of the preferred embodiment In shapes such as the star shape shown in FIG. 2C, a circular spiral-shaped coiled spring 104 may be used and may be connected only to the inside corners of body 102 In all embodiments in FIGS. 2A-G, upper and lower lips 108, if used, may be composed of a wire shaped in the same shape as the cross sectional shape of body 102 of the device.

The device may be composed of material of any color, including transparent, and may be adorned with various designs, included variegations, and may have various logos applied to the exterior thereof such as sports team logos or trademarks of companies, in which case, they may be used as promotional devices.

In operation, the device is compressed and held in both hands with the leading edge of the device containing baffle 100 pointed away from the thrower and the trailing edge resting on the thrower's thumbs and/or palms, as the thrower's fingers hold the device in a compressed position, The device is then propelled away from the thrower in a manner similar to passing a basketball utilizing a two handed pass and at the same time, the leading edge of the device is released, allowing the spring 104 to expand, thereby providing a further means to urge the device away from the thrower. If equal force is applied by both hands, the device will spring from the thrower's hand and maintain an aerodynamic flow defining a trajectory of an arc, and will land with the leading edge and the baffle 100 pointing downward, with the distance and trajectory of the device determined by the force of the throw. Thus, the potential energy of spring 104 is converted to kinetic energy as the thrower pushes the device away from his body.

Various activities may be undertaken with the device, including a simple game of catch between two or more persons. In addition, the device may be utilized to playa game involving a target wherein the accuracy of the landing spot of the device may be used to score the game. Other games typically utilizing a ball may also be played with the device of the present invention including a form of dodge ball, golf or tag.

I claim:

1. A throwable toy device comprising:

a. a hollow body portion having an open trailing end;

b. a spring mechanism integrated with said body which allows said body to be compressed and thereafter returned to its original shape; and c. a baffle, covering a leading end of said body opposite said open trailing end such as to restrict air flow through said device, said baffle having an opening defined therein, said opening having an area approximately 30% to 50% of the area of said open trailing end of said device.

2. The device of claim 1 wherein said body portion is generally in the shape of a tube.

3. The device of claim 2 wherein said hollow tube has a cross section having a shape consisting of one of a circle, a rectangle, a triangle, a trapezoid, a star, an oval, a pentagon, a hexagon and an octagon.

4. The device of claim 2 wherein said spring mechanism consists of a coiled wire attached to or integral with said body portion.

5. The device of claim 2 wherein said leading end of said body portion is heavier than said trailing end of said body portion.

6. The device of claim 5 wherein said body portion defines a lip around said leading end and further wherein said lip has a wire integral therewith.

7. The device of claim 5 wherein said baffle is gel-filled.

8. The device of claim 5 wherein said baffle is needle pointed.

9. The device of claim 5 wherein said baffle has one or more wires integral therewith.

10. The device of claim 5 wherein said opening defined in said baffle defines a lip having a wire integral therewith.

11. The device of claim 2 wherein said body portion is composed of a material selected from a group consisting of nylon, Kevlar, plastic, neoprene, cotton fabric and foam.

12. The device of claim 2 wherein said body portion defines a lip around said open trailing end composed of layered and/or stitched material said lip having a wire integral therewith.

13. The device of claim 2 wherein said baffle is composed of a material selected from a group consisting of nylon, Kevlar, plastic, neoprene and plastic.

14. The device of claim 2 wherein said body portion is composed of molded, semi-rigid foam and further wherein said spring mechanism consist of a corrugated area defined in said foam intermediate said trailing and leading ends of said body portion.

15. The device of claim 14 wherein said baffle portion is comprised of a molded, semi-rigid foam and is integral with aid body portion.

16. The device of claim 2 wherein said baffle is attached to said body portion by sewing.

17. The device of claim 2 further comprising a wire integral with said baffle portion providing structural rigidity thereto, said wire having the same general cross sectional shape as said body portion.

18. The device of claim 2 wherein said body portion may be any color, or may be transparent and further wherein said body portion may be decorated with logos or other designs.

19. A collapsible hollow object comprising:

a. a body portion, said body portion being generally tube-shaped and composed of a molded, rigid foam material, having openings on both ends thereof;

b. a corrugation in said rigid foam material defined in said body portion intermediate said open ends; and c. a baffle, defined on and covering one open end of said body portion, said baffle having an opening therein, said baffle generally restricting the airflow through said body portion, said opening in said baffle having an area approximately 30% to 50% of the area of the open end of said body portion opposite said baffle.

20. A collapsible hollow object comprising:

a. a body portion, said body portion being generally tube-shaped and composed of a flexible fabric material, having openings defined on both ends thereof;

b. a coiled spring device, attached to said body portion at one or more points; and c. a baffle, and covering one open end of said body portion, said baffle having an opening therein, said baffle generally restricting the airflow through said body portion, said opening in said baffle having an area approximately 30% to 50% of the area of the open end of said body portion opposite said baffle.

* * * * *